US008961149B2

(12) United States Patent
Mussalo et al.

(10) Patent No.: US 8,961,149 B2
(45) Date of Patent: Feb. 24, 2015

(54) METHOD FOR CONTROLLING A REGULATED-ROTATION-SPEED LOW-PRESSURE CENTRIFUGAL FAN

(71) Applicant: Runtech Systems Oy, Kolho (FI)

(72) Inventors: Jouni Mussalo, Kotka (FI); Mauri Vuohelainen, Kotka (FI)

(73) Assignee: Runtech Systems Oy, Kolho (FI)

( * ) Notice: Subject to any disclaimer, the term of this patent is extended or adjusted under 35 U.S.C. 154(b) by 0 days.

(21) Appl. No.: 14/047,555

(22) Filed: Oct. 7, 2013

(65) Prior Publication Data

US 2014/0037426 A1 Feb. 6, 2014

Related U.S. Application Data

(63) Continuation-in-part of application No. 12/851,190, filed on Aug. 5, 2010, now abandoned.

(30) Foreign Application Priority Data

Jul. 19, 2010 (FI) ..... 20105810

(51) Int. Cl.

| | |
|---|---|
| ***F04B 49/10*** | (2006.01) |
| ***F04D 15/00*** | (2006.01) |
| ***F04D 27/02*** | (2006.01) |
| ***F04D 27/00*** | (2006.01) |

(52) U.S. Cl.

CPC ..... *F04D 15/0022* (2013.01); *F04D 27/0207* (2013.01); *F04D 27/009* (2013.01)

USPC ..... 417/280; 417/292; 417/53

(58) Field of Classification Search

CPC F04D 15/0022; F04D 27/009; F04D 27/0207

USPC ..... 417/53, 279, 280, 292

See application file for complete search history.

(56) References Cited

U.S. PATENT DOCUMENTS

| | | | |
|---|---|---|---|
| 4,322,668 | A | 3/1982 | Trussler et al. |
| 4,452,585 | A | 6/1984 | Arp |
| 4,525,660 | A | 6/1985 | Katto |
| 4,581,900 | A | 4/1986 | Lowe et al. |
| 4,659,976 | A | 4/1987 | Johanson |
| 4,686,834 | A | 8/1987 | Haley et al. |
| 4,753,711 | A | 6/1988 | Bolton et al. |
| 5,320,499 | A | 6/1994 | Hamey et al. |
| 5,894,736 | A | 4/1999 | Beaverson et al. |
| 6,092,029 | A | 7/2000 | Bently |
| 6,501,629 | B1 | 12/2002 | Marriott |
| 6,868,906 | B1 | 3/2005 | Vail, III et al. |
| 2002/0018721 | A1 | 2/2002 | Kobayashi et al. |
| 2003/0057904 | A1 | 3/2003 | Sacher |

(Continued)

FOREIGN PATENT DOCUMENTS

| | | | |
|---|---|---|---|
| DE | 10 2007 035 712 | A1 | 2/2009 |
| EP | 0 179 658 | A2 | 4/1986 |

(Continued)

*Primary Examiner* — Charles Freay

(74) *Attorney, Agent, or Firm* — Birch, Stewart, Kolasch & Birch, LLP

(57) ABSTRACT

A method for controlling an automatic stall-prevention of a rotation-speed-regulated centrifugal fan. A control automatics is controlled by an automation system of the process wherein, the control automatics stalling is detected from a function of the electric current, voltage and frequency going to the motor of the centrifugal fan.

13 Claims, 1 Drawing Sheet

(56) References Cited

U.S. PATENT DOCUMENTS

| | | | |
|---|---|---|---|
| 2008/0074063 | A1 | 3/2008 | Fulton et al. |
| 2008/0188173 | A1 | 8/2008 | Chen et al. |
| 2009/0019925 | A1 | 1/2009 | Moen |
| 2009/0252617 | A1 | 10/2009 | Mertens et al. |
| 2010/0194325 | A1 | 8/2010 | Dixon et al. |
| 2010/0198480 | A1 | 8/2010 | Mertens et al. |
| 2011/0163704 | A1 | 7/2011 | Wang et al. |

FOREIGN PATENT DOCUMENTS

| | | | |
|---|---|---|---|
| EP | 0368557 | A2 | 5/1990 |
| WO | WO 9954628 | A1 | 10/1999 |
| WO | WO 2009/007681 | A2 | 1/2009 |
| WO | WO 2010141815 | A2 | 12/2010 |

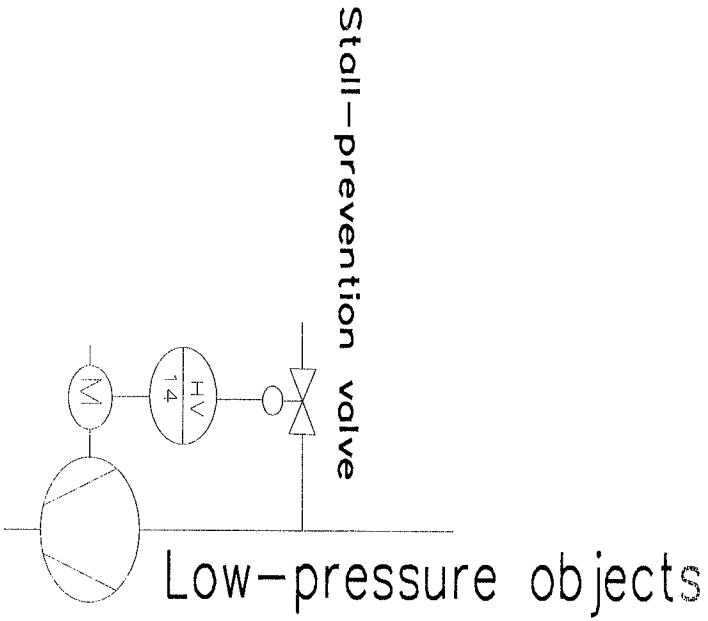
Stall-prevention valve
HV
14
M
Low-pressure objects

METHOD FOR CONTROLLING A REGULATED-ROTATION-SPEED LOW-PRESSURE CENTRIFUGAL FAN

CROSS-REFERENCE TO RELATED APPLICATIONS

This application is a Continuation-In-Part of co-pending U.S. application No. 12/851,190 filed on Aug. 5, 2010, which claims priority to FI 20105810, filed on Jul. 19, 2010. The entire contents of all of the above applications are hereby incorporated by reference.

BACKGROUND OF THE INVENTION

1. Field of the Invention

A method for controlling an automatic stall-prevention of regulated-rotation-speed low-pressure centrifugal fan and a control automatics therefor.

2. Description of Background Art

Numerous compressors and centrifugal fans of different types, depending on their various applications, are known in the art. Particularly in industry, centrifugal fans, compressors and radial fans are widely used to achieve a pressure difference in piping. A problem for all centrifugal fan is generally known to be stalling. In other words, stalling is a characteristic state for all centrifugal fans, which occurs when the volume flow rate is too small in relation to the speed of rotation of the impeller. In this case the angle of incidence between the flow and the blade changes to be so disadvantageous that the flow disengages from the surface of the blade. Backflow is then able to occur in the blade passage and the impeller loses its pressure-increasing ability.

In this way, cyclical pressure fluctuations are generated that excite the natural frequencies of the structure surrounding, among other things, the piping. Pressure fluctuations create fatigue loading in the piping and in the structures. In addition, the temperature of the flow can significantly rise when the impeller, via the losses, continuously gives thermal energy to the gas, but the effective flow can be very small.

Problems occur particularly in processes in which resistance to the flow greatly changes. When using a centrifugal fan for producing low pressure in these types of processes, a stalling state must be prevented by giving leakage air to the centrifugal fan in a controlled manner.

Conventionally, centrifugal fans that have a constant speed of rotation have been used. In this case stalling is prevented with an automatic leakage air valve, which receives control from the current of the drive motor of the centrifugal fan. In the stalling state the current of the drive motor is smaller than in the normal operating range. The electric current also fluctuates strongly. The control logic of the centrifugal fan can easily be programmed to detect a stalling state and to eliminate it by means of leakage air.

Another problem is that in a stalling state the low pressure also fluctuates with a rapid cycle, and this situation is detrimental from the viewpoint of the process. A device that has a regulated speed of rotation has been launched in the low-pressure centrifugal fan market as a new technology, the stall control of which cannot be implemented with conventional technology.

SUMMARY AND OBJECTS OF THE INVENTION

According to an embodiment of the present invention a device with a regulated rotation speed is provided, and that is in itself prior art, that can now be more precisely utilized. By means of this technology a solution is obtained with which a centrifugal fan can be implemented in which the prior-art problems described above do not occur. In addition, the efficiency of the different possibilities of a centrifugal fan can now be significantly enhanced and at the same time the operation of the whole apparatus can be optimized.

In the solution according to an embodiment of the invention the advantages of a centrifugal fan that has a regulated speed of rotation are now utilized more effectively. In this invention a new solution for stall control is presented, which also enables the stall prevention of a rotation-speed-regulated centrifugal fan. In addition, the solution prevents a centrifugal fan from ending up in a stall situation.

With the solution according to an embodiment of the invention, it is possible at the same time to implement applications that are considerably more versatile and more technically demanding. Thus the problems caused by prior art are avoided. The features essential to the invention significantly affect the stall-prevention and also the method defined in the claims. The solution according to the invention has many important advantages.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention and wherein:

FIG. 1 is a schematic view of a device according to the present invention.

DETAILED DESCRIPTION OF THE PREFERRED EMBODIMENT

According to FIG. 1, it is essential in the invention that the points between different flow quantities and the speeds of rotation corresponding to them when stalling starts, and more particularly when it ends, are determined by test-running and with measurements. With these data a limit or range can be mathematically interpolated when lapsing into a stall is evident. Moving to this limit or into this range is prevented by giving more flow to the centrifugal fan from outside the actual intake object as leakage air or, alternatively, from a second intake object. Additional flow is given after an adjustable mathematical safety limit has been exceeded and the additional flow is reduced after falling below a second mathematical limit. These limits follow each other at a distance from each other, which distance is set by the adjustable hysteresis factor.

The speed of rotation of the centrifugal fan is measured constantly with a frequency converter or with a separate measuring apparatus. The flow of air/gas is calculated by means of the electric current and voltage going to the motor of the centrifugal fan, as well as by means of the temperature and pressure of the flow, or with a separate measuring apparatus designed for it. The control automatics controls the valve that adjusts the additional flow on the basis of the aforementioned measured data and calculated stalling limit.

A calculated stall curve is defined for each centrifugal fan in the commissioning of it and with its actual piping. In this way stalling points at different speeds are sought, and the voltage and electric current are measured after coming out of the stall, at the same time checking whether it is possible to stay outside a stalling state. The flow resistance of the piping is adjusted from the most final point possible such that all the air volume of the pipe is included when determining the points. The factors in the formula below are determined from these points. The final adjustment is made after programming the curve and then the final variable of the quadratic equation, with which variable the curve can be raised or lowered, is changed. In this way the most precise operation possible is achieved for the valve.

When the stalling point is approached, the valve is opened and when the situation normalizes the valve is closed. A stalling state is detected from the voltage, current and frequency. In between is a small differential gap in which nothing is done. This prevents unnecessary to-and-fro control of the valve.

Programming for the automation system of the process is most preferably implemented as follows:

Control of stall-prevention valve (HV14)

A stalling state of the centrifugal fan is detected from a function of the current, voltage and frequency going to the motor. According to the calculated result, the stall-prevention valve is either opened or closed according to the need. In addition, the effect of the temperature of the flow is taken into account in the formula.

EXAMPLE

If $U.I.N.(Tp/Tk)^2/1000<0.0032\ F^2+0.1099\ F+10.15$, the valve is opened e.g. 5%, if the valve is not already fully open (100%).

If $U.I.N^2.(Tp/Tk)^2/1000>0.0032\ F^2+0.1099\ F+10.15$, the valve is closed e.g. 5%, if the valve is not already fully closed (0%).

The valve control is repeated e.g. at intervals of 1-10 seconds and most preferably in the range of 5 seconds or of another applicable time.

U=Supply voltage of motor from frequency converter [V]

I=Supply current of motor from frequency converter [A]

F=Supply frequency of motor current [Hz]

N=Hysteresis adjustment factor

Tk=Temperature in test conditions [K]

Tp=Temperature of intake air [K]

The formulas modeling the stalling limit that are presented above are mathematical examples. What is at issue here are the mathematical graphs fitted to measured pairs of points, the forms of which graphs vary case by case. The formulas set forth above are the present invention. The variables in the formula, such as voltage, current, frequency or temperature, are dependent on the formula. The formula controls two safety limits using different configurations of variables. The especially created mathematical formula provides for automatic control. The flow of air is automatically controlled from a secondary air source with a stall prevention valve HV14. This adjustment is automatically controlled based on the formula. The speed of rotation of the centrifugal fan is measured constantly with a frequency converter. The need of air flow from the secondary air source to prevent stalling is detected from this measured data and automatically controlled by the formula.

It is obvious to the person skilled in the art that the invention is not limited to the embodiments presented above, but that it can be varied within the scope of the claims presented below.

The invention claimed is:

1. A method for controlling an automatic stall-prevention of a rotation-speed-regulated centrifugal fan, comprising the following steps:

controlling automatics by means of an automation system of a process, and detecting control automatics stalling from a function of the current, voltage and frequency going to a motor of the centrifugal fan;

wherein the controlling is defined such that when $U.I.N.(Tp/Tk)^2/1000<0.0032\ F^2+0.1099\ F+10.15$, a valve is opened 5% from it's current position or $U.I.N^2.(Tp/Tk)^2/1000>0.0032\ F^2+0.1099\ F+10.15$, the valve is closed 5% from it's current position;

wherein U=supply voltage of the motor from a frequency converter

I=supply current of the motor from a frequency converter

F=supply frequency of the motor current

N=hysteresis adjustment factor

Tk=temperature in test conditions

Tp=temperature of intake air.

2. The method according to claim 1, wherein additional flow is given to the rotation-speed-regulated centrifugal fan after a first predetermined limit has been exceeded and the additional flow is reduced after falling below a second predetermined limit.

3. The method according to claim 1, wherein the valve is controlled cyclically such that a control cycle is in the range of 1-10 seconds.

4. The method according to claim 1, wherein points between different flow quantities and speeds of rotation corresponding to them are determined by test-running and by measuring, attributes are made at points at which stalling starts, and when the stalling ends, wherein limits and/or ranges are interpolated.

5. The method according to claim 2, wherein the valve is controlled cyclically such that a control cycle is in the range of 1-10 seconds.

6. The method according to claim 2, wherein points between different flow quantities and speeds of rotation corresponding to them are determined by test-running and by measuring, attributes are made at points at which stalling starts, and when the stalling ends, wherein limits and/or ranges are interpolated.

7. The method according to claim 1, wherein the valve is controlled cyclically such that a control cycle is in the range of 5 seconds.

8. The method according to claim 2, wherein the valve is controlled cyclically such that a control cycle is in the range of 5 seconds.

9. Control automatics for an automatic stall-prevention of a rotation-speed-regulated centrifugal fan, comprising:

the control automatics programmed into an automation system of a process, wherein control automatics stalling is detected from a function of the current, voltage and frequency going to a motor of the centrifugal fan;

wherein the control automatics is defined such that when $U.I.N.(Tp/Tk)^2/1000<0.0032\ F^2+0.1099\ F+10.15$, a valve is opened 5% from it's current position or $U.I.N^2.(Tp/Tk)^2/1000>0.0032\ F^2+0.1099\ F+10.15$, the valve is closed 5% from it's current position;

wherein U=supply voltage of the motor from a frequency converter

I=supply current of the motor from a frequency converter

F=supply frequency of the motor current

N=hysteresis adjustment factor

Tk=temperature in test conditions

Tp=temperature of intake air.

10. The control automatics according to claim 9, wherein additional flow is given to the rotation-speed-regulated centrifugal fan after a first predetermined limit has been exceeded and the additional flow is reduced after falling below a second predetermined limit.

11. The control automatics according to claim 9, wherein the valve is controlled cyclically such that a control cycle is in the range of 1-10 seconds.

12. The control automatics according to claim 9, wherein points between different flow quantities and speeds of rotation corresponding to them are determined by test-running and by measuring, attributes are made at points at which stalling starts, and at when the stalling ends, wherein limits and/or ranges are interpolated.

13. The method according to claim 9, wherein the valve is controlled cyclically such that a control cycle is in the range of 5 seconds.

* * * * *